US005642552A

United States Patent [19]

Wang

[11] Patent Number: 5,642,552

[45] Date of Patent: Jul. 1, 1997

[54] RETRACTABLE HANDLE POSITIONING MECHANISM FOR WHEELED SUITCASES

[76] Inventor: King-Sheng Wang, No. 569, Ching-Kuo Rd., Ta-Chia Chen, Taichung Hsien, Taiwan

[21] Appl. No.: 531,398

[22] Filed: Sep. 21, 1995

Related U.S. Application Data

[63] Continuation-in-part of Ser. No. 239,236, May 6, 1994, abandoned.

[51] Int. Cl.[6] ..... B25G 1/04

[52] U.S. Cl. ..... 16/115; 190/115; 190/18 A

[58] Field of Search ..... 16/115; 190/115, 190/18 A; 280/655

[56] References Cited

U.S. PATENT DOCUMENTS

| | | | |
|---|---|---|---|
| 5,374,073 | 12/1994 | Hsin | 280/655 |
| 5,414,895 | 5/1995 | Kazmark, Jr. | 16/115 |
| 5,431,428 | 7/1995 | Marchwiak et al. | 16/115 |
| 5,438,731 | 8/1995 | Kazmark, Jr. | 16/115 |
| 5,526,908 | 6/1996 | Wang | 16/115 |
| 5,586,628 | 12/1996 | Wang | 16/115 |

*Primary Examiner*—M. Rachuba
*Assistant Examiner*—Donald M. Gurley
*Attorney, Agent, or Firm*—Bacon & Thomas

[57] ABSTRACT

A retractable handle positioning mechanism including a base frame fixed to the shell of a wheeled suitcase and having two axle housings disposed in a parallel relation a retractable handle mounted in the axle housings and moved between an extended position and a retracted position, spring-supported retainer rods mounted in the retractable handle for locking it in the extended position or the retracted position, a trapezoidal press button mounted in a top button slot on the base frame, and two spring-supported bolts mounted inside the base frame and controlled by the trapezoidal press button to release the spring-supported retainer rods for permitting the retractable handle to be moved between the extended position and the retracted position.

2 Claims, 11 Drawing Sheets

RETRACTABLE HANDLE POSITIONING MECHANISM FOR WHEELED SUITCASES

CROSS-REFERENCE TO RELATED APPLICATION

The present invention is a continuation-in-part of patent application Ser. No. 08/239,236, filed on May 6, 1994 now abandoned.

BACKGROUND OF THE INVENTION

The present invention relates to a retractable handle positioning mechanism for wheeled suitcases, and relates more particularly to such a retractable handle positioning mechanism which uses a trapezoidal press button to release the retractable handle for permitting it to be moved between the extended position and the retracted position.

Various wheeled suitcases are known having a retractable handle for carrying. "CART AND LUGGAGE HANDLE ASSEMBLY WITH A PUSH BUTTON ACTUATOR" of U.S. Pat. No. 5,434,895, as shown in FIG. 1, discloses a handle assembly for carts and wheeled luggage which includes a pair of tube assemblies disposed in substantially parallel relation and connected by a handle member. The handle assembly includes an actuating and latching apparatus for releasably locking the tube assemblies in an extended or retracted position. "FOLDABLE HAND TRUCK" of U.S. Pat. No. 4,974,871, as shown in FIG. 2, discloses a foldable hand truck comprising a retractable and extendible push handle set having a first set of round holes and a second set of round holes, a platform, a wheel set, a platform retraction mechanism, and a push button for controlling the platform retraction mechanism, and a pair of movable push rods, wherein two out ends of the pair of movable push rods may insert into either the first set of round holes or the second set of round holes on the push handle set, and two inner ends of the pair of movable push rods may shift within two slant slots formed on the push button so as to pull the two outer ends out of the first or the second set of round holes while the push button being pressed down. "TRACTIVE BAGGAGE HANDCART" of U.S. Pat. No. 5,374,073, as shown in FIGS. 3 and 4, discloses a tractive baggage handcart comprising a travel case, a tractive retractable device, a base retractable device, and a tie belt, wherein the retractive retractable device is provided with telescopic upper, middle and lower retractable pipes for shortening or lengthening the vertical dimension of the handcart. "TELESCOPIC LUGGAGE HANDLE ASSEMBLY WITH PRESS BUTTON RELEASE" of UK Pat. No. 2,278,319, as shown in FIG. 5, discloses a handle assembly for carts or wheeled luggage, which includes a pair of nesting assemblies disposed in parallel relation and connected by a handle member, tube assemblies carry lock buttons which cooperate with an acutator and release assembly to releasably lock the tube assemblies in an extended or retracted position, and a press button or turnable knob disposed between the two tube assemblies to release the locks. "CONTROLLER FOR COLLAPSIBLE TYPE CONTRACTIBLE BAGGAGE CART" of U.S. Pat. No. 5,178,404 discloses a controller for contracting the collapsible rods of a baggage carrier wherein a spring-biased sliding element carried by the controller body is pushed downwardly to cause retraction of stop members provided on the rods, thereby permitting the rods to be quickly collapsed into each other when a handle mounted at the top of the rods is also pushed downwardly.

SUMMARY OF THE INVENTION

It is one object of the present invention to provide a retractable handle positioning mechanism which permits the retractable handle to be conveniently operated between the extended position and the retracted position. It is another object of the present invention to provide a retractable handle positioning mechanism which is easy to install and to maintain. According to one embodiment of the present invention, the retractable handle positioning mechanism comprises a base frame fixed to the shell of a wheeled suitcase and having two axle housings disposed in a parallel relation a retractable handle mounted in the axle housings and moved between an extended position and a retracted position, spring-supported retainer rods mounted in the retractable handle for locking it in the extended position or the retracted position, a trapezoidal press button mounted in a top button slot on the base frame, and two spring-supported bolts mounted inside the base frame and controlled by the trapezoidal press button to release the spring-supported retainer rods for permitting the retractable handle to be moved between the extended position and the retracted position.

DETAILED DESCRIPTION OF THE PREFERRED EMBODIMENT

Figure 1:
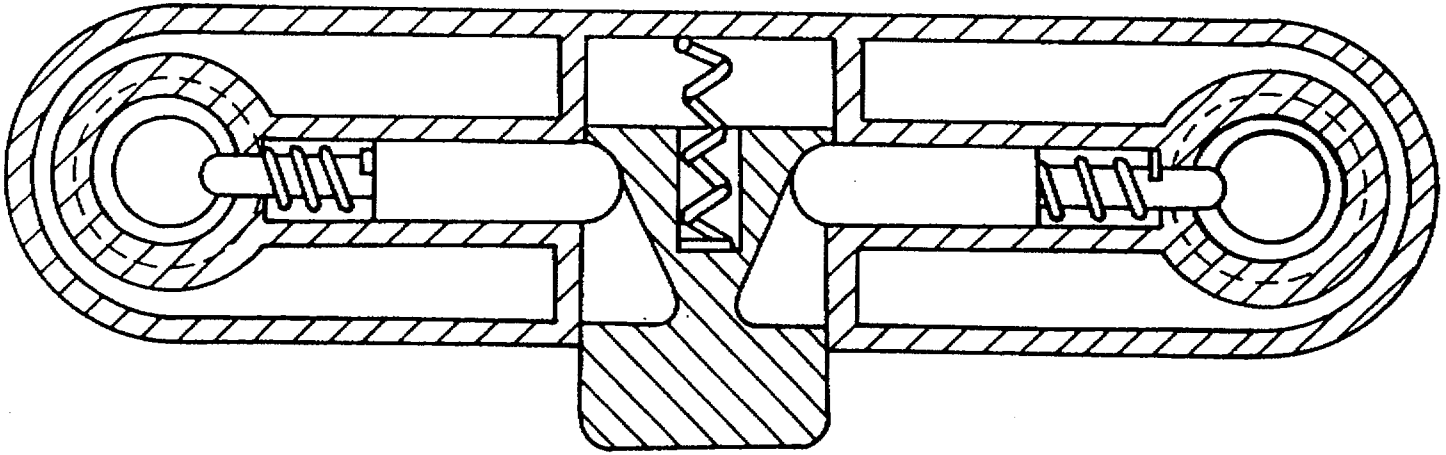
Fig. 1 PRIOR ART
FIG. 1 is a sectional view showing a handle assembly positioned in a luggage CART according to U.S. Pat. No. 5,434,895.
Figure 2:
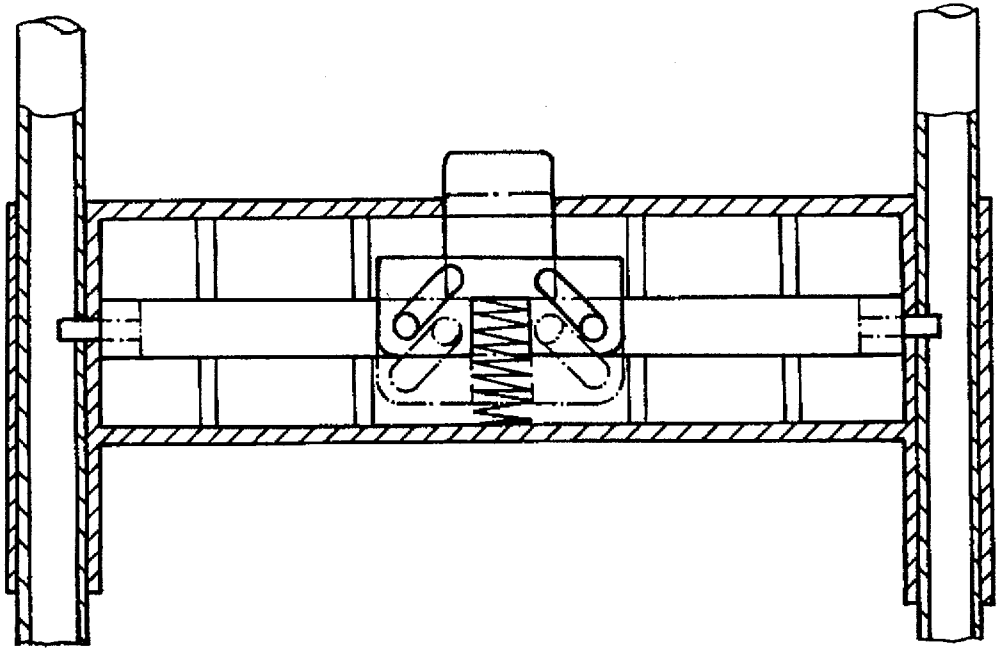
Fig. 2 PRIOR ART
FIG. 2 is a sectional view of a foldable hand truck according to U.S. Pat. No. 4,974,871.
Figure 3:
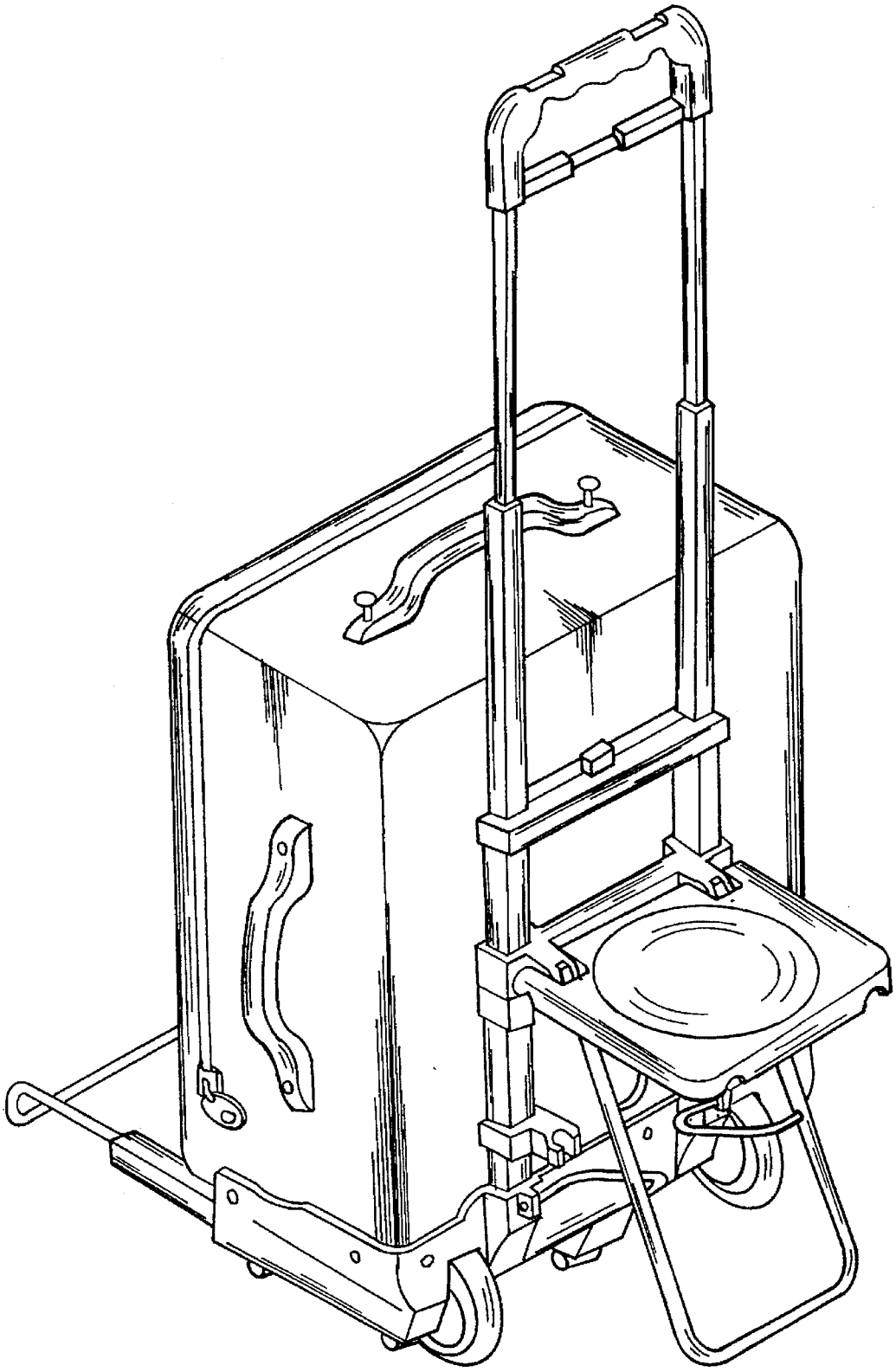
Fig. 3 PRIOR ART
FIG. 3 is an elevational view of a tractive baggage handcart according to U.S. Pat. No. 5,374,073.
Figure 4:
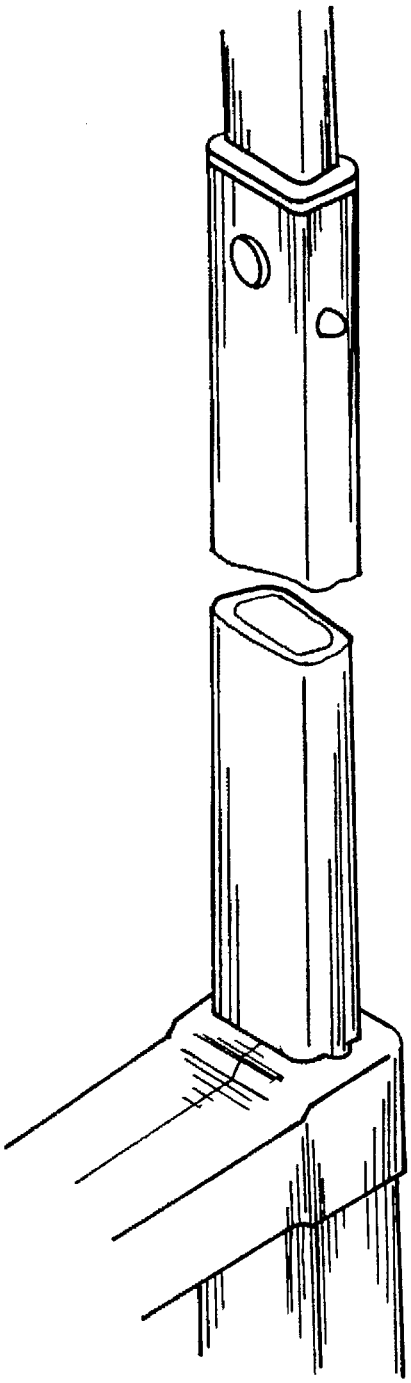
Fig. 4 PRIOR ART
FIG. 4 is an exploded view of the tractive retractable device of the tractive baggage handcart shown in FIG. 3.
Figure 5:
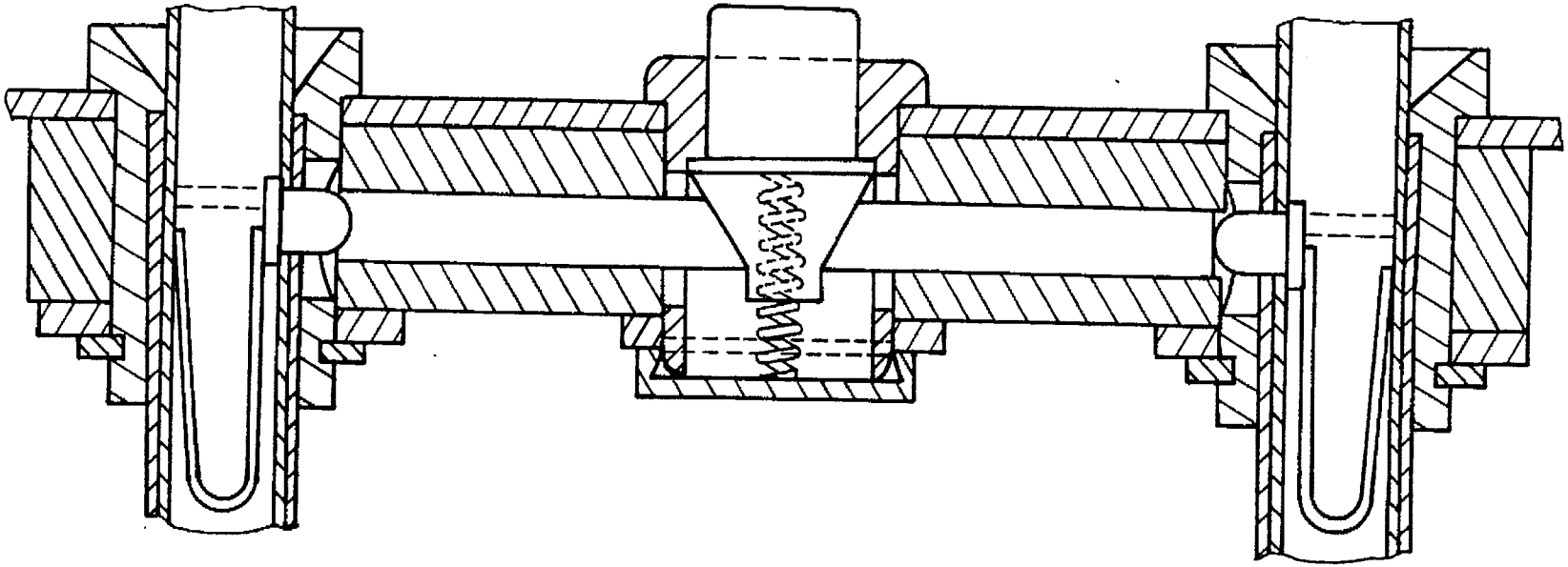
Fig. 5 PRIOR ART
FIG. 5 is a sectional view of a telescopic luggage handle assembly according to UK Pat. No. 2,278,319.
Figure 6:
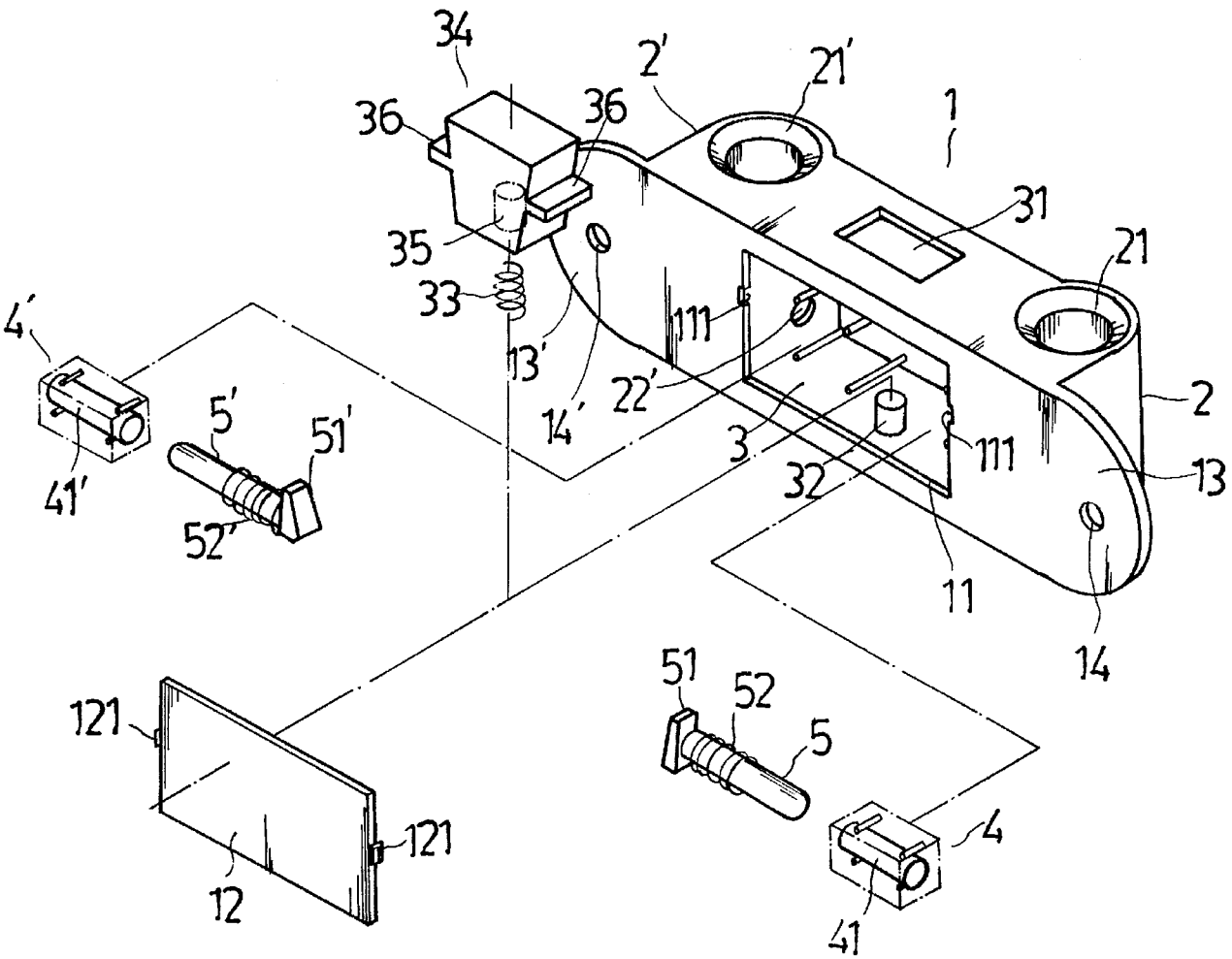
FIG. 6 is an exploded view of a retractable handle positioning mechanism according to the present invention.

Referring to FIG. 6, the retractable handle positioning mechanism of the present invention comprises a hollow base frame 1. The hollow base frame 1 comprises two axle housings 2 and 2' vertically disposed at two opposite ends, each axle housing 2 or 2' defining a respective tapered axle hole 21 or 21', a chamber 3 in the middle, a front opening 11 in communication with the chamber 3, two retaining notches 111 at two opposite ends of the front opening 11, a lid 12 covered on the front opening 11 and having two hooks 121 at two opposite ends respectively hooked in the retaining notches 111, a button slot 31 at the top between the axle housings 2 and 2' and in communication with the chamber 3, and two outward mounting flanges 13 and 13' at two opposite ends, each outward mounting flange 13 or 13' having a respective mounting hole 14 or 14' for fastening to a wheeled suitcase. A spring 33 is mounted on the stub rod 32 to support a trapezoidal press button 34 in the button slot 31. The trapezoidal press button 34 comprises a bottom hole 35, which receives the top end of the spring 33, and two opposite side wings 36, which stop beneath the button slot 31. Two locating blocks 4 and 4' are disposed bilaterally inside the chamber 3, each having a longitudinal bolt hole 41 or 41' for holding a respective headed bolt 5 or 5'. The headed bolt 5 or 5' is inserted through the bolt hole 41 or 41' on one locating block 4 or 4' into a respective lock hole 22 or 22' on one axle housing 2 or 2', having a bevel head 51 or 51' stopped against the trapezoidal press button 34 at one side. A spring 52 or 52' is mounted around the headed bolt 5 or 5' and stopped between the bevel head 51 or 51' and the locating block 4 or 4'.

Figure 7:
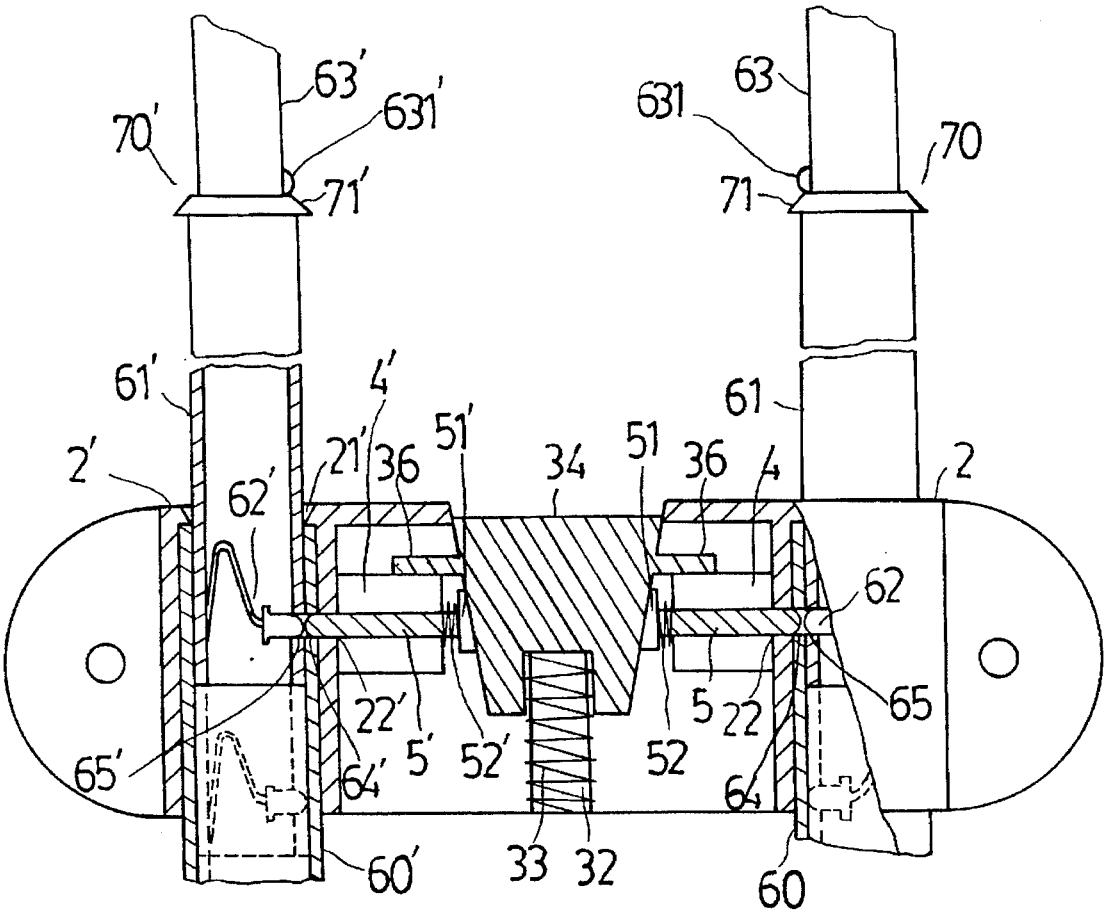
FIG. 7 is a sectional view showing the positioning of a retractable handle in the retractable handle positioning mechanism of FIG. 6.

Referring to FIG. 7, the retractable handle positioning mechanism is installed in a suitcase 8 to hold a retractable handle, which is comprised of two sleeves 60 and 60' disposed in parallel relation, two intermediate tubes 61 and 61' slidably inserted into the sleeves 60 and 60', and two joined inner tubes 63 and 63' slidably inserted into the intermediate tubes 61 and 61'. The top ends of the sleeves 60 and 60' are respectively fastened to the tapered axle holes 21 and 21' of the axle housings 2 and 2'. The top ends of the intermediate tubes 61 and 61' protrude over the tapered axle holes 21 and 21' of the axle housings 2 and 2'. Each of the sleeves 60 and 60' has a through hole 64 or 64' near the top end facing one lock hole 22 or 22' of the base frame 1. Each of the intermediate tubes 61 and 61' has two through holes 65 or 65' near two opposite ends, and two spring-supported retainer rods 62 or 62' respectively projecting out of the through holes 65 or 65'. One spring-supported retainer rod 62 or 62' of each intermediate tube 61 or 61' projects into the lock hole 22 or 22' and disposed in contact with the headed bolt 5 or 5' when the intermediate tubes 61 and 61' are moved to the extended position or retracted position. When the intermediate tubes 61 and 61' are pulled out of the sleeves 60 and 60', the respective spring-supported retainer rods 62 and 62' are respectively inserted into the through holes 64 and 64' of the sleeves 60 and 60' and the lock holes 22 and 22' of the base frame 1 to lock the intermediate tubes 61 and 61' in the extended position. When the press button 34 is pressed down to compress the spring 33, the headed bolts 5 and 5' are forced outwards in reversed directions to push the respective spring-supported retainer rods 62 and 62' away from the lock holes 22 and 22' of the base frame 1 and the through holes 64 and 64' of the sleeves 60 and 60', thereby for permitting the intermediate tubes 61 and 61' to be moved back inside the sleeves 60 and 60'. When the intermediate tubes 61 and 61' are moved to the retracted position and received inside the sleeves 60 and 60', the springs 52 and 52' automatically force the headed bolts 5 and 5' back to their former positions, and the spring 33 automatically forces the press button 34 back to its former position.

Figure 8:
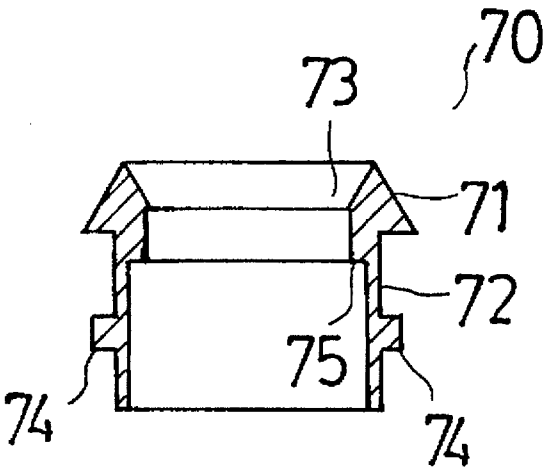
FIG. 8 is a sectional view of a tubular plug cap according to the present invention.
Figure 9:
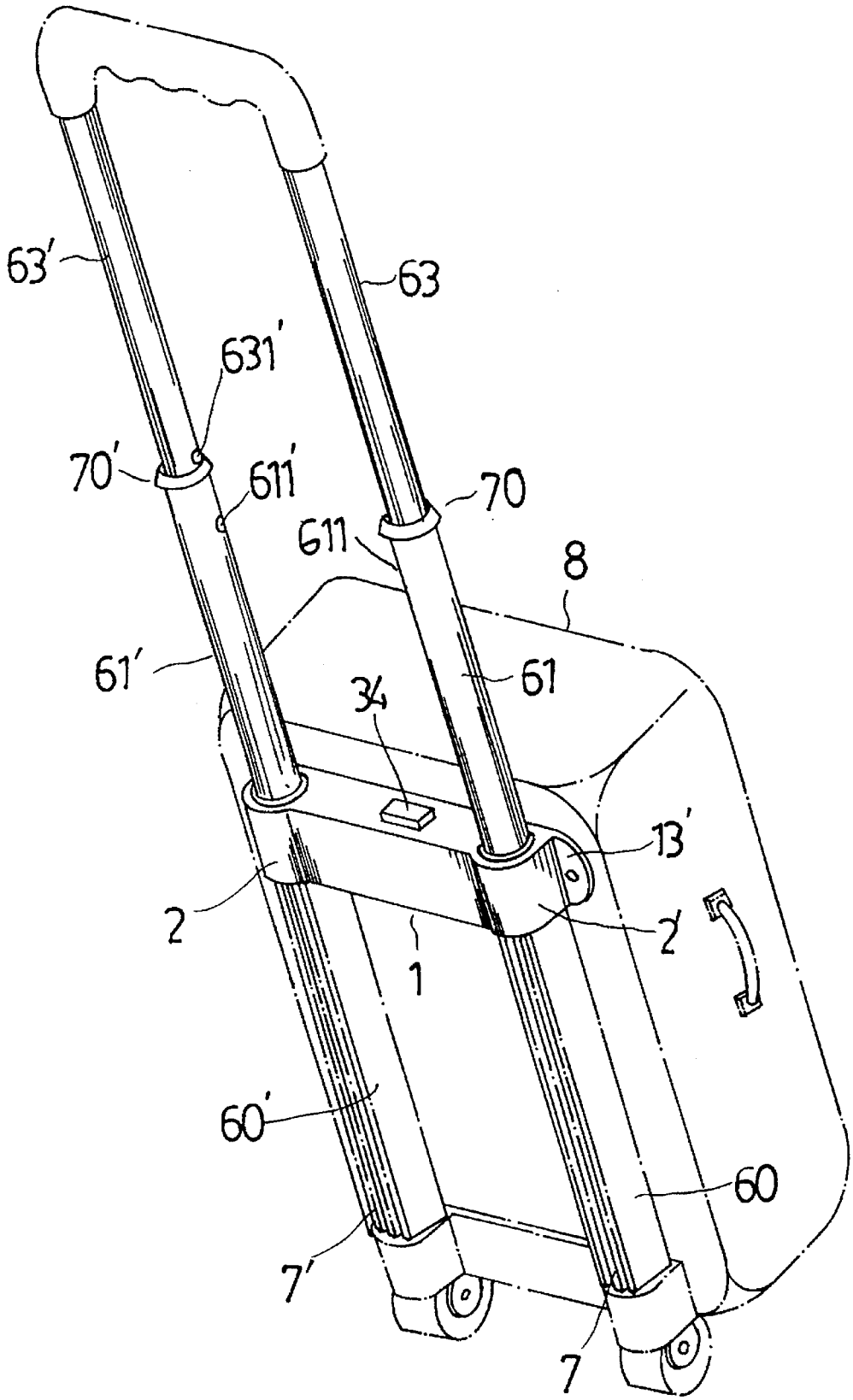
FIG. 9 is an applied view of the present invention, showing the retractable handle positioning mechanism installed in a wheeled suitcase.

Referring to FIGS. 8 and 9, and FIG. 7 again, each of the intermediate tubes 61 and 61' has a top end mounted with a tubular plug cap 70 or 70'; each of the inner tubes 63 has a spring-supported retainer rod 631 or 631' at the bottom end. When the inner tubes 63 are moved to the extended position, the spring-supported retainer rods 631 and 631' protrude out of the tubular plug caps 70 and 70' of the intermediate tubes 61 and 61' and are stopped above the tubular plug caps 70 and 70' to hold the inner tubes 63 at the extended position. The tubular plug cap 70 or 70' comprises a tubular body 72, a top flange 71 around the top end of the tubular body 72, a stop edge 75 on the inside, which stops the flanged bottom end of one inner tube 63 or 63' when the inner tubes 63 and 63' are moved to the extended position, a tapered top orifice 73 of which the diameter reduces gradually toward the stop edge 75, and two opposite locating rods 74 raised from the periphery and fitted into respective locating holes 611 or 611' on the intermediate tube 61 or 61'. Furthermore, the bottom ends of the sleeves 60 and 60' are protected by a respective impact baffle 7 or 7'.

Figure 10:
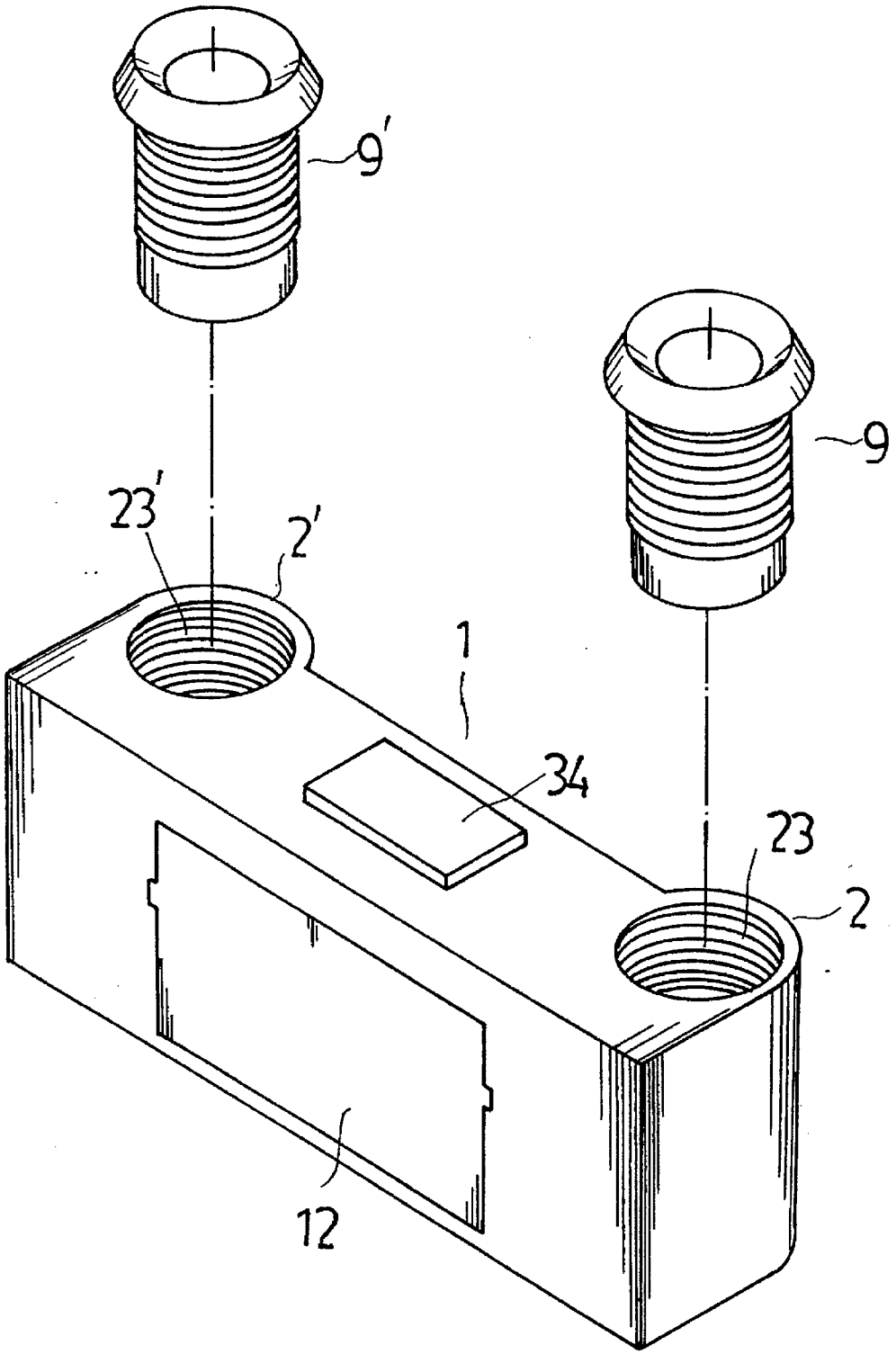
FIG. 10 shows an alternate form of the base frame according to the present invention.
Figure 11:
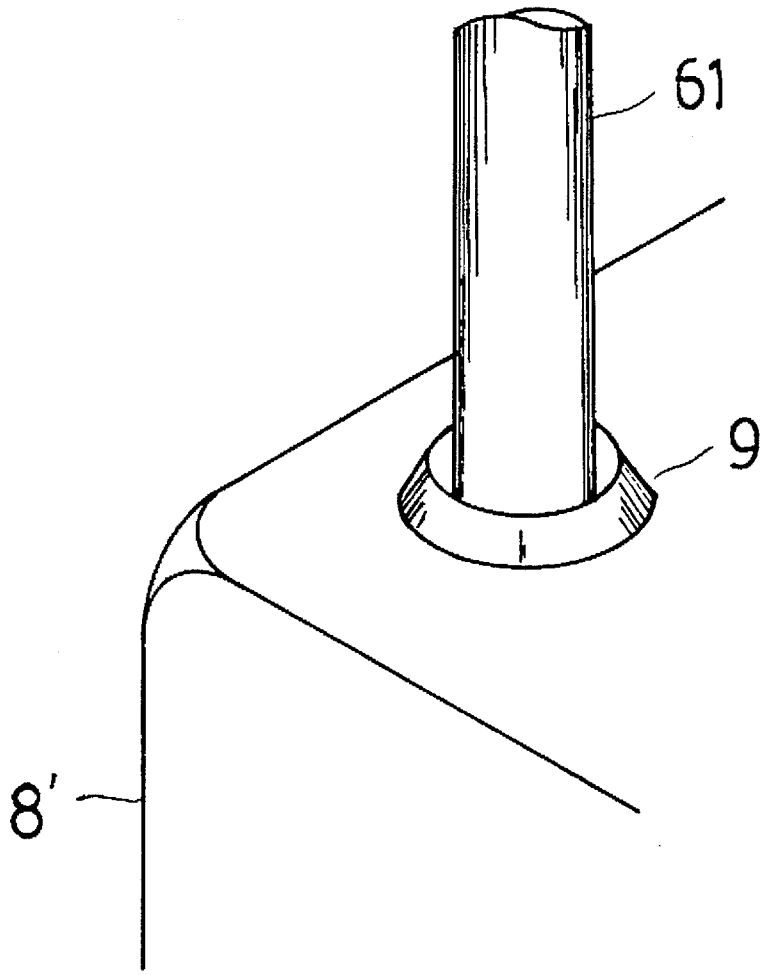
FIG. 11 shows the base frame of FIG. 10 installed in a suitcase according to the present invention.

Referring to FIGS. 10 and 11, as an alternate form of the present invention, the axle housings 2 and 2' of the base frame 1 are made having a respective screw hole 23 or 23'. When the base frame 1 is mounted inside the suitcase, two tubular screw members 9 and 9' are respectively threaded into the screw holes 23 and 23' from the outside of the suitcase to fixedly secure the base frame 1 to the suitcase. Furthermore, the lid 12 can be removed from the base frame 1 for checking the mechanism inside the base frame 1.

I claim:

1. A retractable handle positioning mechanism for a suitcase having a shell comprising:

a base frame fastened to the shell of the suitcase to hold a retractable handle, said base frame having two laterally spaced apart axle holes, a chamber in the middle between said two axle holes, a front opening communicating with said chamber, a stub rod on said base frame located inside said chamber, a top button slot communicating with said chamber having a width W, a lock hole communicating with each of said axle holes and two mounting flanges extending from opposite sides of said base frame laterally outwardly of said two axle holes;

a first spring mounted on said stub rod inside said chamber;

a trapezoidal press button having a substantially rectangular cross-sectional configuration located in said chamber and supported on said first spring, a portion of said press button disposed in said top button slot, the press button having at least two side wings extending from opposite sides of the press button, the distance between distal ends of the side wings being greater than the width W of the top button slot to prevent the press button from passing completely through the top button slot;

two locating blocks bilaterally mounted inside said chamber of said base frame, each having a bolt hole communicating between said chamber and the lock hole of one axle housing;

two headed bolts, each headed bolt having a bolt body sliding in the bolt hole of one locating block, and a beveled head bearing against one side of said trapezoidal press button;

a second spring respectively mounted around the bolt body of each headed bolt and extending between the beveled head of each headed bolt and one of said locating blocks so as to bias the beveled head against the press button; and a retractable handle fastened to said base frame, and operated by means of the control of said trapezoidal press button between an extended position and a retracted position, whereby when said trapezoidal press button is pressed, the headed bolts are forced laterally outwards by said trapezoidal press button in opposite directions to push spring-supported retainer rods away from lock holes of said base frame, thereby permitting inside tubes of said retractable handle to be moved between said extended position and said retracted position.

2. A retractable handle positioning mechanism for a suitcase having a shell comprising:

a base frame fastened to the shell of a suitcase to hold a retractable handle, said base frame having two laterally spaced apart axle holes each axle hole forming a threaded hole, a chamber in the middle between said two of the holes, a front opening communicating with said chamber, a stub rod on said base frame located inside said chamber, a top button slot communicating with said chamber having a width W, a lock hole communicating with each of said axle holes wherein the base frame is fastened to an inside of the shell of said suitcase by a tubular screw member threaded into each of said axle holes, each said tubular screw member having a tapered top orifice;

a first spring mounted on said stub rod inside said chamber;

a trapezoidal press button having a substantially rectangular cross-sectional configuration located in said chamber and supported on said first spring, a portion of said press button disposed in said button slot, the press button having at least two side wings extending from opposite sides of the press button, the distance between distal ends of the side wings being greater than the width W of the top button slot to prevent the press button from passing completely through the top button slot;

two locating blocks bilaterally mounted inside said chamber of said base frame, each having a bolt hole communicating between said chamber and the lock hole of one axle housing;

two headed bolts, each headed bolt having a bolt body sliding in the bolt hole of one locating block, and a beveled head bearing against one side of said trapezoidal press button;

a second spring respectively mounted around the bolt body of each headed bolt and extending between the beveled head of each headed bolt and one of said locating blocks so as to bias the beveled head against the press button; and a retractable handle fastened to said base frame, and operated by means of the control of said trapezoidal press button between an extended position and a retracted position;

whereby when said trapezoidal press button is pressed, the headed bolts are forced laterally outwards by said trapezoidal press button in opposite directions to push spring-supported retainer rods away from lock holes of said base frame, thereby permitting inside tubes of said retractable handle to be moved between said extended position and said retracted position.

* * * * *